US010689243B2

(12) United States Patent
Scatterday

(10) Patent No.: US 10,689,243 B2
(45) Date of Patent: Jun. 23, 2020

(54) METERED DISPENSING DEVICE FOR PLANT EXTRACTS

(71) Applicant: Mark A. Scatterday, Scottsdale, AZ (US)

(72) Inventor: Mark A. Scatterday, Scottsdale, AZ (US)

( * ) Notice: Subject to any disclaimer, the term of this patent is extended or adjusted under 35 U.S.C. 154(b) by 0 days.

(21) Appl. No.: 16/283,291

(22) Filed: Feb. 22, 2019

(65) Prior Publication Data

US 2019/0263653 A1 Aug. 29, 2019

Related U.S. Application Data

(60) Provisional application No. 62/634,289, filed on Feb. 23, 2018.

(51) Int. Cl.
*B67D 3/00* (2006.01)
*B65D 83/00* (2006.01)

(52) U.S. Cl.
CPC ..... *B67D 3/0041* (2013.01); *B65D 83/00* (2013.01); *B65D 83/0011* (2013.01)

(58) Field of Classification Search
CPC ... B67D 3/0041; B65D 83/00; B65D 83/0011
See application file for complete search history.

(56) References Cited

U.S. PATENT DOCUMENTS 4,189,065 A * 2/1980 Herold ..... G01F 11/027 222/390
4,595,124 A * 6/1986 Duval ..... B65D 83/0011 222/39
5,423,752 A * 6/1995 Haber ..... A61M 5/19 222/137
5,582,598 A * 12/1996 Chanoch ..... A61M 5/31551 222/309
5,599,314 A * 2/1997 Neill ..... A61M 5/31555 222/391
5,688,251 A * 11/1997 Chanoch ..... A61M 5/3146 222/309
5,851,079 A * 12/1998 Horstman ..... A45D 34/042 401/174
5,960,998 A * 10/1999 Brown ..... B05B 11/0005 222/131
7,018,365 B2 * 3/2006 Strauss ..... A61K 9/0024 222/390
7,213,994 B2 * 5/2007 Phipps ..... A61M 35/003 222/390

(Continued)

*Primary Examiner* — Frederick C Nicolas

(74) *Attorney, Agent, or Firm* — Schmeiser, Olsen & Watts LLP

(57) ABSTRACT

A metered dispensing device for plant extracts is provided. The device includes a main body having an inner volume for holding plant extract, a rotatable dial operably coupled on an end of the main body, a dispensing end located on an end of the main body opposite the rotatable dial, and a dispensing tip coupled to the dispensing end. The device also includes a dispensing mechanism including a plunger moveable along the length of the main body in response to rotation of the dial. The plunger pushes plant extract from the inner volume out the dispensing tip. The device also includes a feedback system providing tactile and audible feedback after a predetermined amount of plant extract has been dispensed through the dispensing tip.

16 Claims, 2 Drawing Sheets

(56) References Cited

U.S. PATENT DOCUMENTS

| | | | | |
|---|---|---|---|---|
| 7,597,495 | B2 * | 10/2009 | Gueret | A45D 34/04 401/130 |
| 8,550,300 | B2 * | 10/2013 | Lee | B05B 11/3074 222/95 |
| 9,386,840 | B2 * | 7/2016 | Huang | A45D 40/06 |
| 10,004,852 | B2 * | 6/2018 | Marsh | A61M 5/20 |
| 10,076,610 | B2 * | 9/2018 | Bayer | A61M 5/20 |
| 10,420,890 | B2 * | 9/2019 | Jugl | A61M 5/31511 |
| 2013/0197448 | A1 * | 8/2013 | Butler | A61M 5/31525 604/207 |
| 2016/0051766 | A1 * | 2/2016 | Marsh | A61M 5/20 604/207 |
| 2016/0067414 | A1 * | 3/2016 | Bayer | A61M 5/20 604/211 |

* cited by examiner

METERED DISPENSING DEVICE FOR PLANT EXTRACTS

CROSS REFERENCE TO RELATED APPLICATION[S]

This application claims priority to U.S. Provisional Patent Application entitled "METERED DISPENSING DEVICE FOR PLANT EXTRACTS," Ser. No. 62/634,289, filed Feb. 23, 2018, the disclosure of which is hereby incorporated entirely herein by reference.

BACKGROUND OF THE INVENTION

Technical Field

This invention relates generally to a dispensing device and more particularly to a metered dispensing device for plant extracts.

State of the Art

There are many different types of dispensing devices for plant extracts. These dispensing devices do not have a means to meter the amount of plant extract that is being dispensed and therefore lack the ability to operate as means for medicinal purposes that require specific amounts of plant extracts.

Accordingly, there is a need for an improved dispensing device.

DISCLOSURE OF THE INVENTION

The present invention relates to a metered dispensing device for plant extracts. The metered dispensing device includes a manual feedback to mark a predetermined amount of dispensed plant extract.

An embodiment includes a metered dispensing device for plant extracts, the device comprising: a main body having an inner volume for holding plant extract; a rotatable dial operably coupled on an end of the main body; a dispensing end located on an end of the main body opposite the rotatable dial; a dispensing tip coupled to the dispensing end; a dispensing mechanism including a plunger moveable along the length of the main body in response to rotation of the dial, wherein the plunger pushes plant extract from the inner volume out the dispensing tip; and a feedback system providing tactile and audible feedback after a predetermined amount of plant extract has been dispensed through the dispensing tip.

Another embodiment includes a metered dispensing device for plant extracts, the device comprising: a main body having an inner volume for holding plant extract, the inner volume having a first end and a second end; a rotatable dial operably coupled on an end of the main body; a dispensing end located on an end of the main body opposite the rotatable dial, wherein the first end of the inner volume is located near the rotatable dial and the second end of the inner volume is located at the dispensing end; a dispensing mechanism including a plunger moveable along the length of the main body in response to rotation of the dial, wherein the plunger pushes plant extract from the inner volume out the dispensing tip; and a feedback system providing tactile and audible feedback after a predetermined amount of plant extract has been dispensed through the dispensing tip.

Yet another embodiment includes a method of using metered dispensing device for plant extracts, the device comprising: rotating a rotatable dial of the metered dispensing device in a first direction; dispensing extract from a dispensing end of the metered dispensing device in response to rotation of the rotatable dial in the first direction; automatically providing tactile, audible or tactile and audible feedback after a predetermined rotational distance of the rotatable dial, wherein the predetermined rotational distance of the rotatable dial corresponds to a predetermined metered amount of extract being dispensed from the metered dispensing device; and drawing in excess extract in response to rotating the rotatable dial in a second direction opposite the first direction.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a metered dispensing device for plant extracts. The metered dispensing device includes tactile and audible feedback to mark a predetermined amount of dispensed plant extracts.

Figure 1:
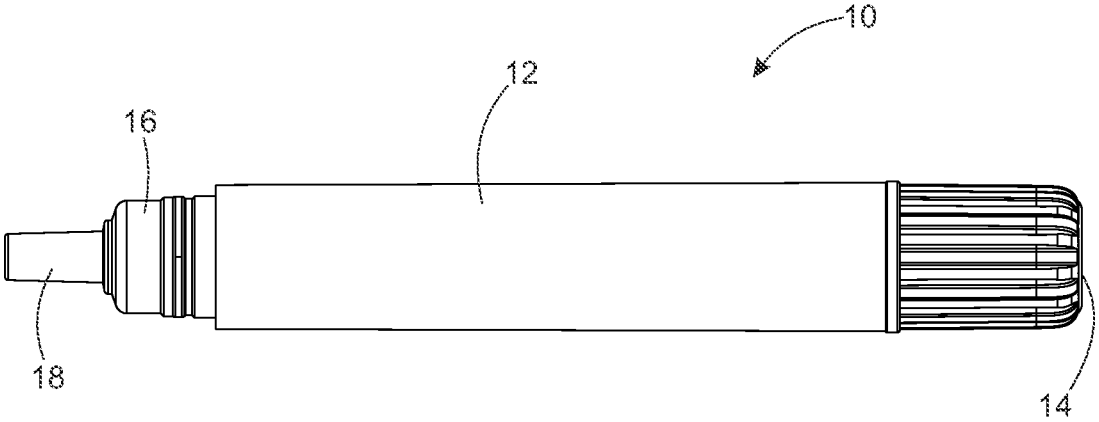
FIG. 1 is a side view of a metered dispensing device in accordance with embodiments.
Figure 2:
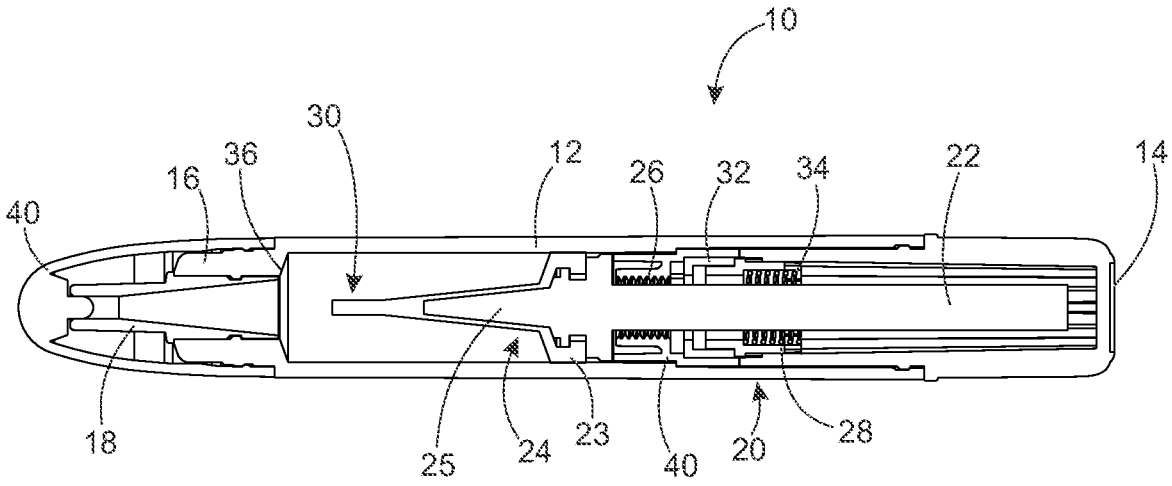
FIG. 2 is a side section view of a metered dispensing device in accordance with embodiments.

FIGS. 1 and 2 depict a metered dispensing device 10 in accordance with embodiments. The device 10 includes a main body 12, a rotatable dial 14 operably coupled on an end of the main body 12, a dispensing end 16 located on an end of the main body 12 opposite the rotatable dial 14, and a dispensing tip 18 coupled to the dispensing end 16. The device 10 may include a dispensing mechanism 20. The main body 12 may include an inner volume 30 with a first end 34 located near the rotatable dial 14 and a second end 36 located at the dispensing end 16. In other words, the second end 36 of the inner volume 30 is located at the dispensing end 16 and the inner volume 30 extends along a length of the interior of the main body 12 and terminates at the first end 34 at a predetermined distance closer to the rotatable dial 14 than is the second end 36.

The dispensing mechanism 20 includes a plunger formed of a plunger rod 22 with a plunger end 24. The plunger end 24 is located within an inner volume 30 fillable with plant extracts located within the main body 12, wherein the plunger end 24 includes base portion 23 that engages the sides of the inner volume 30 and an extended portion 25 that is extendable within and corresponding to the shape of an inner volume of the dispensing tip 18. Further, the base portion 23 may further include a tapered portion extending between edges of the base portion and the portion of the extended portion 25 coupled to the base portion 23, wherein the tapered portion corresponds to a tapered portion on a dispensing end of the device 10. This extended portion 25 and, in some embodiments, a tapered portion of the base portion 23, allows the plunger end 24 to expel a majority of plant extract that is stored within inner volume 30. In other words, the base portion 23 and the extended portion 25 of the plunger end 24 may have an external surface profile that corresponds to and matches in the internal surface profile of the dispensing end of the device 10.

The plunger rod 22 is coupled to the dial 14 on one end and to the plunger end 24 on the opposing end. The coupling to the dial 14 allows the plunger rod to rotate in response to rotating the dial 14. The device 10 may further include a nut 40 having aperture with threads, the nut coupled within the main body 12 in a fixed location. The nut 40 may engage threads of the plunger rod 22, wherein the plunger rod 22 extends through the nut 40 and the threads of the plunger rod 22 operationally engage the threads of the nut 40. The rotation of the dial 14 in a first direction rotates the plunger rod 22 and moves the plunger rod linearly along the length of the main body 12 toward the dispensing end 16.

The dispensing mechanism 20 includes a feedback system that includes a spring 28 and a moveable body 32, wherein the spring 28 and the moveable body 32 are operatively coupled to coaxially around the plunger rod 22. During rotation of the plunger rod 22, the spring and the moveable body 32 operate to engage each other and the moveable body 32 compresses the spring 28 until the plunger rod has rotated a predetermined amount, wherein the moveable body 32 is no longer restricted and the spring 28 pushes the moveable body 32 quickly and in accordance with the spring force toward the dispensing end 16. This operation of the spring 28 and the moveable body 32 provides tactile feedback by causing the main body 12 to quickly move and also provides an audible click feedback. The feedback indicates to a user that the predetermined amount of plant extract has been dispensed. In some embodiments, the predetermined amount of extract or fluid dispensed is 25 μl each time the feedback system is activated. In embodiments, the shape and geometry of the moveable body 32 can be adjusted in accordance with the amount of extract or fluid desired to be dispensed, wherein the feedback system of the spring 38 and the moveable body 32 would have a configuration to allow for the movement at certain periods of rotation of the dial 14 to correspond to feedback at a desired dispensing amount.

Accordingly, the rotation of the dial 14 therefore rotates the plunger rod 22 to move the plunger end 24 along the inner volume 30 toward the dispensing end 16 pushing plant extract through the dispensing tip 18, the feedback system alerting the user that the predetermined amount of plant extracts has been dispensed. In further embodiments, the dial 14 is configured to be rotated in a second direction opposite the first direction that draws the plunger rod 22 and the plunger end 24 toward the dial 14 to drawback plant extracts and prevent unintended overflow of the plant extracts during dispensing. In embodiments, the dial 14 is configured to rotate one full turn in the second direction. The operation of the feedback system is what provides the metered dispensing of the plant extracts.

The device 10 may also include a cap 40 that operates to keep the plant extracts within the inner volume 30 when not in use by plugging the dispensing tip 18. The cap 40 is releasably coupled to the dispensing end 16.

Figure 3:
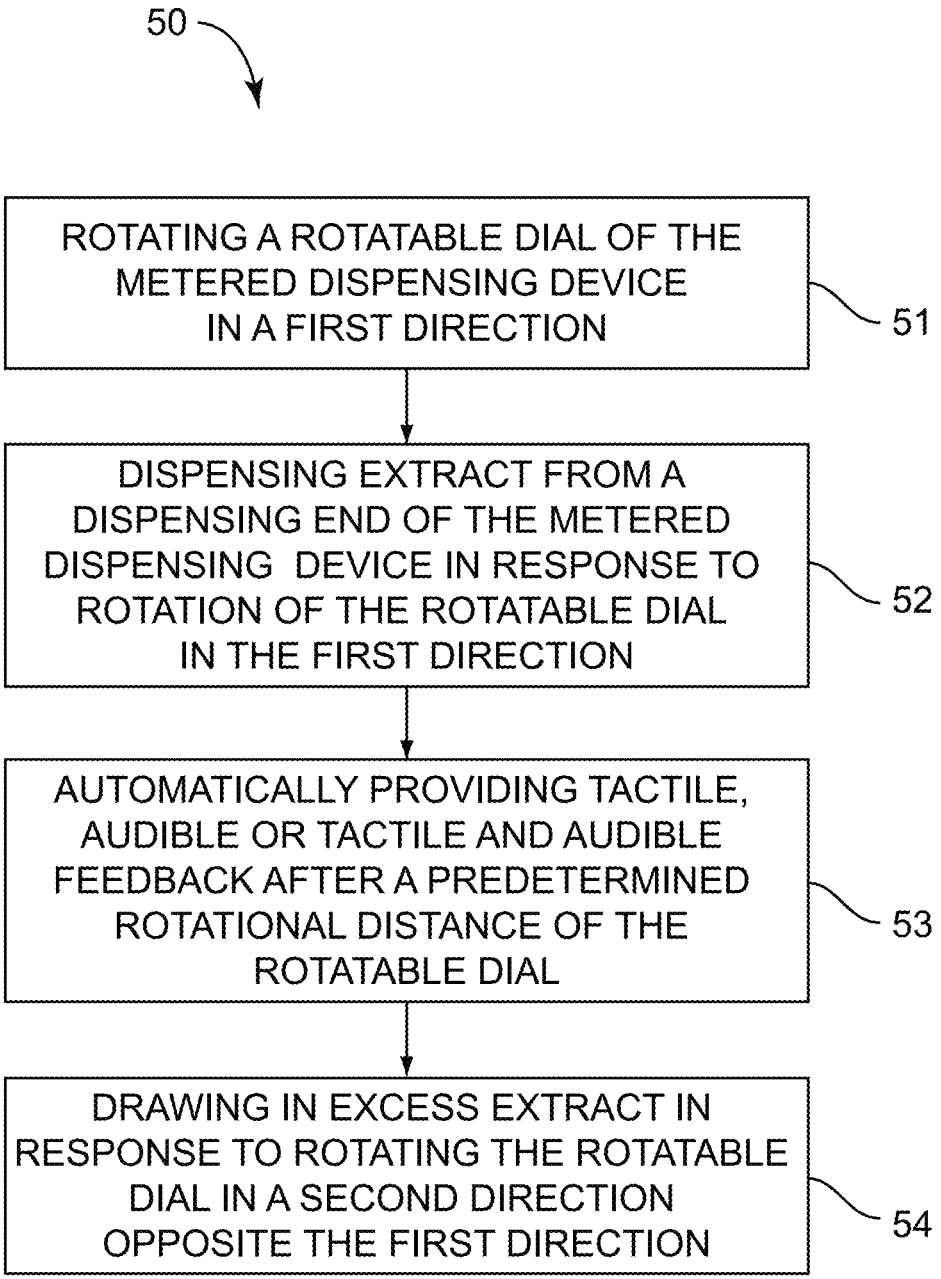
FIG. 3 is a flow chart depicting a method of using a metered dispensing device in accordance with embodiments.

Referring further to the drawings, FIG. 3 depicts a method 50 of using a metered dispensing device according to an embodiment. The method 50 may include rotating a rotatable dial of the metered dispensing device in a first direction (Step 51); dispensing extract from a dispensing end of the metered dispensing device in response to rotation of the rotatable dial in the first direction (Step 52); automatically providing tactile, audible or tactile and audible feedback after a predetermined rotational distance of the rotatable dial (Step 53), wherein the predetermined rotational distance of the rotatable dial corresponds to a predetermined metered amount of extract being dispensed from the metered dispensing device; and drawing in excess extract in response to rotating the rotatable dial in a second direction opposite the first direction (Step 54).

Accordingly, the components defining any metered dispensing device may be formed of any of many different types of materials or combinations thereof that can readily be formed into shaped objects provided that the components selected are consistent with the intended operation of a metered dispensing device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any metered dispensing device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A metered dispensing device for plant extracts, the device comprising:

a main body having an inner volume for holding plant extract;

a rotatable dial operably coupled on an end of the main body;

a dispensing end located on an end of the main body opposite the rotatable dial;

a dispensing tip coupled to the dispensing end;

a dispensing mechanism including a plunger moveable along the length of the main body in response to rotation of the dial, wherein the plunger comprises a plunger rod coupled to the dial and a plunger end, comprising a base portion and an extended portion, coupled to the plunger rod, wherein rotation of the dial rotates the plunger rod, wherein the plunger pushes plant extract from the inner volume out the dispensing tip; and a feedback system providing tactile and audible feedback after a predetermined amount of plant extract has been dispensed through the dispensing tip.

2. The device of claim 1, wherein the base portion and the extended portion have an external surface profile that corresponds to and matches an interior surface profile of the dispensing end and dispensing tip of the metered dispensing device.

3. The device of claim 1, further comprising a nut having an aperture with threads, the nut coupled within the main body in a fixed location.

4. The device of claim 3, wherein the plunger rod comprises threads, wherein the plunger rod extends through the aperture of the nut and the threads of the plunger rod engage the threads of the nut.

5. The device of claim 3, wherein the threaded engagement between the plunger rod and the nut moves the plunger rod linearly along a length of the main body in response to rotation of the rotatable dial.

6. A metered dispensing device for plant extracts, the device comprising:

a main body having an inner volume for holding plant extract, the inner volume having a first end and a second end;

a rotatable dial operably coupled on an end of the main body;

a dispensing end located on an end of the main body opposite the rotatable dial, wherein the first end of the inner volume is located near the rotatable dial and the second end of the inner volume is located at the dispensing end;

a dispensing mechanism including a plunger moveable along the length of the main body in response to rotation of the dial, wherein the plunger pushes plant extract from the inner volume out the dispensing tip;

a feedback system providing tactile and audible feedback after a predetermined amount of plant extract has been dispensed through the dispensing tip; and wherein the feedback system comprises a spring and a moveable body coupled to and coaxially around the plunger rod within the inner volume in a position where the spring engages the moveable body on one end and engages the first end of the inner volume on the other end.

7. The device of claim 6, wherein the moveable body is operatively coupled to the moves toward the first end of the inner volume in response to rotation of the plunger rod, wherein the spring is compressed between the first end of the inner volume and the moving moveable body.

8. The device of claim 7, wherein after a predetermined amount of rotation, the moveable body is disengaged from the plunger rod and the spring pushes the moveable body quickly and in accordance with the spring force toward the second end of the inner volume, wherein the moveable body contacts an inner component of the metered dispensing device.

9. The device of claim 8, wherein the tactile and audible feedback are produced in response to the moveable body contacting the inner component of the metered dispensing device.

10. The device of claim 6, further comprising a dispensing tip coupled to the dispensing end.

11. The device of claim 10, wherein the plunger further comprises a plunger rod coupled to the dial, wherein rotation of the dial rotates the plunger rod.

12. The device of claim 11, wherein the plunger further comprises a plunger end coupled to the plunger rod, wherein the plunger end comprises a base portion and an extended portion.

13. The device of claim 12, wherein the base portion and the extended portion have an external surface profile that corresponds to and matches an interior surface profile of the dispensing end and dispensing tip of the metered dispensing device.

14. The device of claim 13, further comprising a nut having an aperture with threads, the nut coupled within the main body in a fixed location.

15. The device of claim 14, wherein the plunger rod comprises threads, wherein the plunger rod extends through the aperture of the nut and the threads of the plunger rod engage the threads of the nut.

16. The device of claim 15, wherein the threaded engagement between the plunger rod and the nut moves the plunger rod linearly along a length of the main body in response to rotation of the rotatable dial.

* * * * *